United States Patent [19]

Truesdale et al.

[11] Patent Number: 5,019,449

[45] Date of Patent: May 28, 1991

[54] SPINNERET AND YARN PRODUCED THEREBY

[75] Inventors: Wade J. Truesdale, York, S.C.; Bryan B. Moore, Pineville, N.C.; Greg F. Benjock, Rock Hill, S.C.

[73] Assignee: Celanese Fibers, Inc., New York, N.Y.

[21] Appl. No.: 24,119

[22] Filed: Mar. 10, 1987

[51] Int. Cl.[5] ..... D02G 3/00

[52] U.S. Cl. ..... 428/397; 57/243; 57/248; 428/364; 428/373; 428/374

[58] Field of Search ..... 428/397, 373, 364, 374; 57/248, 243; 264/177.13

[56] References Cited

U.S. PATENT DOCUMENTS 3,156,607 11/1964 Strachan ..... 264/177.13 X

*Primary Examiner*—Lorraine T. Kendell

*Attorney, Agent, or Firm*—Forrest D. Stine; Philip P. McCann

[57] ABSTRACT

A spinneret having octagonally-shaped orifices for producing yarn filaments having a characteristic cross-section and improved cross-sectional fidelity. The filament cross-section is characterized by generally symmetrical rectangular sub-sections each having four lobes and joined one to the other by a central bridging portion connecting the short facing sides of the sub-sections. This cross-section has increased surface area and remains substantially constant throughout the length of the filament whereby reduced air pressure is required when using the filament in air jet looms.

14 Claims, 3 Drawing Sheets

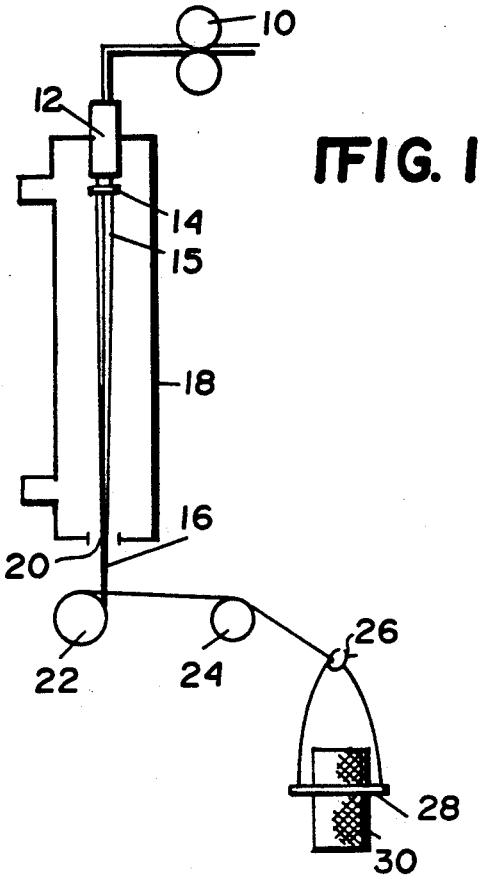
FIG. 1
FIG. 2
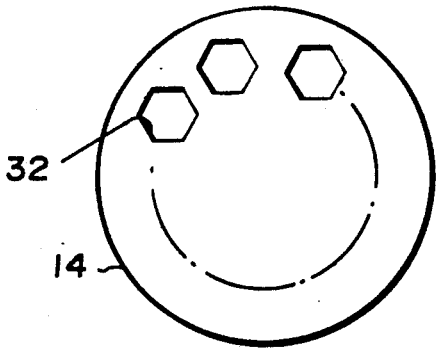
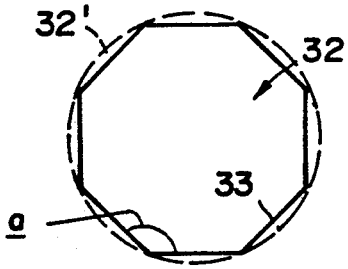
FIG. 3
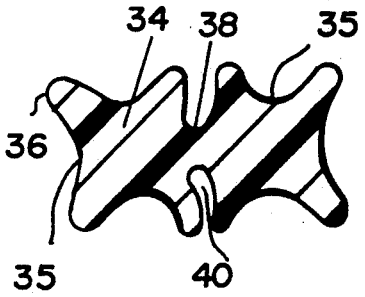
FIG. 4

SPINNERET AND YARN PRODUCED THEREBY

BACKGROUND AND SUMMARY OF THE INVENTION

The present invention relates to the production of yarns by the extrusion of filament-forming material, for example, cellulose acetate, through orifices in a spinneret and particularly relates to spinneret orifices of octagonal configuration, the yarn filaments formed by the extrusion of the filament-forming material through the octagonal spinneret orifices, yarn formed of such filaments and methods of producing the filaments using the octagonal spinneret orifices.

Synthetic yarn filaments are traditionally produced by melt, wet or dry spinning techniques, each being very well known in the art. For the production of cellulose acetate filaments, the dry spinning technique has been utilized quite successfully in the past. That is, a solution (usually called a "dope" in art parlance) comprising cellulose acetate and a volatile solvent therefor (usually acetone) is typically extruded through orifices into a gaseous medium which serves to volatilize and evaporate the solvent thereby forming filaments of cellulose acetate. Usually multiple filaments are extruded, gathered into a yarn and the yarn is then wound upon a bobbin. The yarns are then typically woven into fabrics for a variety of textile end uses including garments, draperies and the like.

The spinneret orifices for the production of cellulose acetate filaments have conventionally been of a circular geometry and produce filaments which can be characterized as crenulated or multi-lobal in cross-section. Circular orifices, however, produce a filament which lacks cross-section fidelity, i.e., such filament lacks uniformity of cross-section or periodic smooth surface portions along its length or, conversely, exhibits substantial cross-sectional variance along its length. Finished fabric produced from yarn filaments lacking cross-sectional fidelity appears to have occasional light or dark streaks resulting from differential light scattering. While such fabrics do exhibit a pleasing hand, efforts have been made to improve the fabric produced from such spinnerets. One such effort is disclosed in U.S. Pat. No. 3,839,526. In that patent, yarn filament is formed by extruding filament-forming material through a multi-grooved orifice defined by alternating convexities and concavities along the surface of the spinneret defining the orifice. The yarn filament produced is multi-lobal in cross-section. Various other cross-sectional shapes of yarn filaments, as well as additional characteristics thereof, are also discussed in that patent.

According to one aspect of the present invention, it has been found that there is a relationship between cross-sectional fidelity and the surface area of the filaments throughout their lengths, on the one hand, and the level of air pressure needed for pick insertion in air jet weaving looms, on the other hand. By increasing the number of lobes in the cross-section of the yarn filament and hence its surface area, it has been found that the filaments are more "air-friendly" for use in air jet looms. That is to say, yarn filaments having increased surface area and substantial and consistent uniformity of cross-section throughout their lengths, according to the present invention, afford improved filling performance on air jet looms at lower air consumption rates and hence reduced costs. They also provide a reduced level of fabric defects. Conversely, the yarn filaments hereof contribute to increased fabric production, while maintaining the cost of such production at a relatively constant level. Moreover, this can be achieved without a decrease in hand of the fabric produced by such yarn filaments. The cross-section of the yarn filament can be controlled in accordance with the present invention through appropriate spinneret design with resulting improvements in lowered air consumption and hence cost or increased fabric production in air jet looms and reduced fabric defects.

In accordance with the present invention, spinnerets with octagonally-shaped exit orifices have been found to significantly and consistently provide an increased crenulation level of filaments formed by extrusion of a dope therethrough in comparison with filaments formed by dope extrusion through circular or round spinneret orifices, as well as reduced variability of the cross-section of the yarn filament throughout its length. Both factors significantly improve uniformity of fabric appearance. This is achieved in accordance with the present invention by providing a spinneret orifice having an octagonal shape. That is to say, the present invention provides a spinneret having a plurality of orifices, at least one of which is defined throughout its full perimetrical extent, by eight discrete side edges, each forming an included angle with an adjacent side edge of between 90° and 180°. Preferably, the orifice is formed of a regular octagon.

Also, according to the present invention, a yarn filament is produced having a cross-sectional shape which may be characterized by a pair of generally symmetrical polygonal sub-sections, each having at least three lobes and joined one to the other by a bridging portion extending between adjacent facing sides of the sub-sections. The sub-sections are each generally rectangular in shape and the bridging portion joins the short facing sides of the rectangular sub-sections. By using spinneret orifices of octagonal shape, an average of seven or more crenulations or lobes in the cross-sections of the yarn filaments is produced. Moreover, a substantial uniformity of filament cross-section throughout its length is achieved. Also, a consistency of cross-section among the various filaments produced from the octagonally-shaped orifices is obtained. These achievements result in improved fabric appearance and reduced air pressure requirements on air jet looms.

An additional benefit derived from the use of an octagonal-shaped orifice in a spinneret is the lack of deterioration of the integrity of the octagonal cross-section with time. Historically, one of the problems with spinnerets having orifices of unusual cross-sections has been the tendency for the filament-forming material to deposit in the orifices. This conventionally results in a deterioration of the ability of the orifices to produce a filament having the targeted cross-section. However, tests of the present octagonally-shaped spinneret orifices have demonstrated no substantial cross-sectional deterioration over time. While some deposit of filament forming material does occur over time, it has been surprisingly discovered that such deposits are uniform from one orifice to another in a spinneret having multiple orifices of this invention. In comparison, a spinneret having multiple round orifices typically exhibits nonuniform deposit of filament forming material or preferential depositing of material from one round orifice to another. This nonuniform depositing of material leads to denier per filament (dpf) variability over time. However, use of the octagonal orifices of this invention reduces dpf variability (as compared to round orifices) and, moreover, maintain such low dpf variability substantially constant over time.

According to a further embodiment of the present invention, there is provided a method of forming filaments for the production of yarn by extruding filament forming material through a spinneret having a plurality of orifices including the step of forming the material in at least one of the orifices into a shape having a cross-sectional shape having eight discrete side edges each forming an included angle with an adjacent side edge of between 90° and 180°.

Accordingly, it is a primary object of the present invention to provide a spinneret orifice configuration for producing yarn filaments having increased crenulation, hence surface area, improved cross-sectional fidelity and consistency, and, when used in air jet looms, affords improved filling performance characterized by lower air consumption rates or increased loom speed.

These and further objects and advantages of the present invention will become more apparent upon reference to the following specification, claims and appended drawings.

BRIEF DESCRIPTION OF THE DRAWING FIGURES

FIG. 1 is a schematic elevational view of a spinneret for producing a yarn filament, both provided in accordance with the present invention;

FIG. 2 is an enlarged plan view of a spinneret illustrating the particular cross-sectional shape of the spinneret orifices;

FIG. 3 is an enlarged view of a spinneret orifice in accordance with the present invention;

FIG. 4 is a cross-sectional view of a typical yarn filament formed by extruding filament-forming material through the octagonal orifice of the spinneret hereof;

Figure 5A:
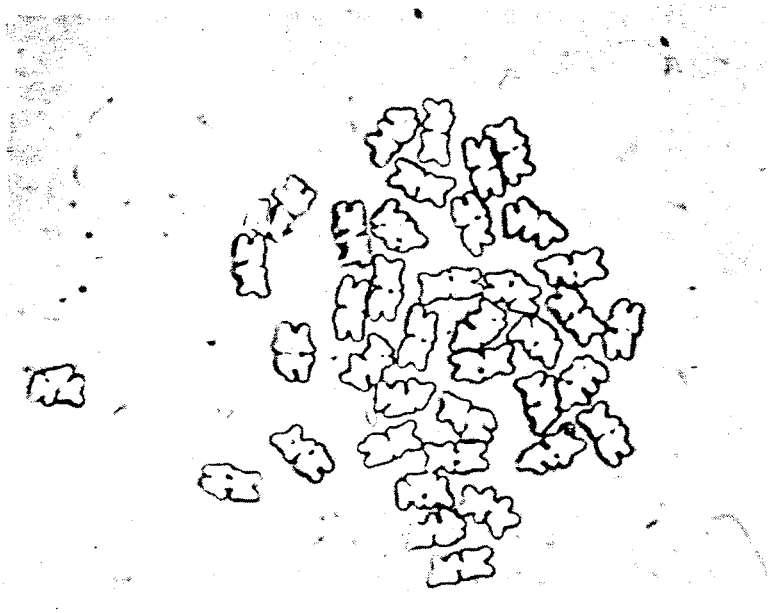
Figure 5B:
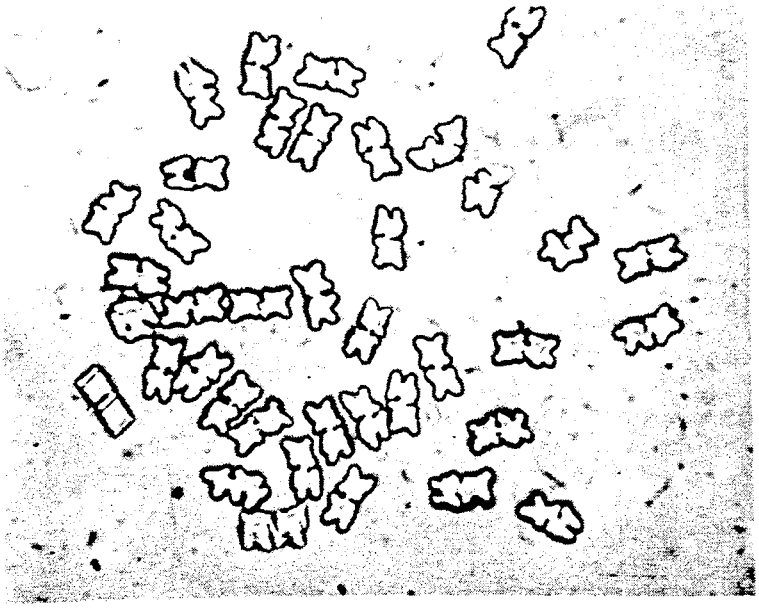
Figure 6:
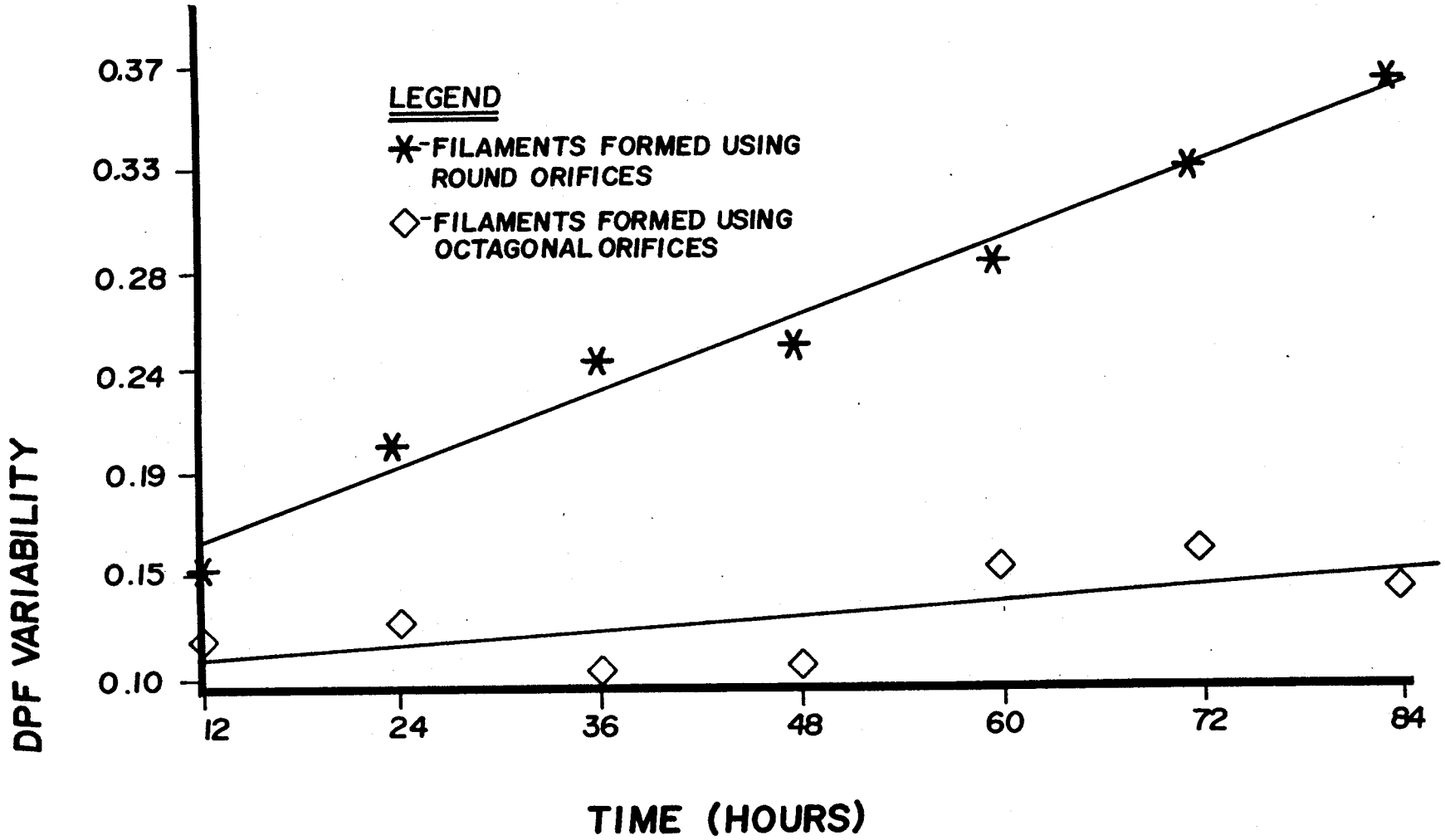

FIGS. 5*a* and 5*b* are microphotographs of two runs of filaments formed using the spinneret constructed in accordance with the present invention; and FIG. 6 is a plot of denier per filament vs. time and compares filaments of this invention to filaments of the prior art produced from round orifices.

DETAILED DESCRIPTION OF THE PRESENT INVENTION

Reference will now be made in detail to the present preferred embodiment of the invention, an example of which is illustrated in the drawings.

Referring now to FIG. 1, there is illustrated a dry spinning apparatus having a metering pump 10 for discharging a filament-forming material through a filter 12 and spinneret 14 to form a bundle of filaments 15 comprising a yarn 16. The column or spinning cabinet 18 houses the spinneret. The yarn 16 leaves the cabinet through an outlet 20 and passes over a feed roll 22 and a lubricating roll 24 and through a balloon guide 26 to a ring and traveler take-up 28 for collection on a bobbin 30. This spinning apparatus, with the exception of the spinneret orifices, and the filament-forming materials used therewith may be the same as described in U.S. Pat. No. 3,839,526 and, accordingly, the disclosure of that patent is incorporated herein by reference.

As best illustrated in FIG. 2, spinneret 14 hereof is provided with a plurality of orifices 32, each having, in accordance with the present invention, a generally octagonal shape. Orifices 32 are generally arranged in a circular configuration about the axis of spinneret 14. The orifices, as best illustrated in FIG. 3, are each preferably formed in the shape of a regular octagon, that is, an octagon having eight sides 33 of equal length with equal angles a between adjacent sides. The apex of adjoining sides 33 forming angle a lies within a circle 32'. While the size of each orifice will establish the resulting denier for filaments produced thereby, it is preferred according to this invention that circle 32' have a diameter of less than about 100$\mu$, and more particularly less than about 50$\mu$.

Referring now to FIGS. 5*a* and 5*b*, there are illustrated microphotographs of two runs of filaments through a spinneret having the octagonal orifices of the present invention. From an examination of these photographs, it will be seen that the cross-sections of the yarn filaments produced have certain generally common characteristics which are represented and illustrated in FIG. 4. For example, the filaments produced by the present invention may be characterized as having a cross-sectional shape corresponding to a pair of substantially symmetrical rectangular sub-sections 34, each sub-section having multiple, at least three, and usually four, lobes 36. Each sub-section is joined one to the other by a relatively narrow central bridging portion 38. The bridging section 38 extends between the short facing sides of the rectangular sub-sections 34. On average, the width-to-depth ratio of this characteristic cross-section of yarn filament 15 is about 2 to 1.

Yarn filaments of this invention may be further characterized as having an increased number of lobes per filament on average with less filament to filament deviation from the average as compared to filaments produced from round orifices. While the number of lobes for each filament of this invention may be greater or lesser in number for a given filament population, on average, the filaments will have a greater number of lobes with less deviation from the average as compared to filaments formed from prior art round orifices. The number of lobes per filament of this invention (as viewed in cross-section) will be, on average, greater than six and will deviate from such average by less than one lobe per filament for a given population of filaments.

Thus, examination of FIGS. 5*a* and 5*b* reveals that the cross-sections of the filaments are not identical one to the other. However, their cross-sectional shapes will generally correspond to the shape illustrated in FIG. 4, and as indicated above will have, on average, greater than six lobes per filament with a deviation from such average of less than one lobe for a given population of filaments.

The characteristic cross-section shown in FIG. 4 may be further described as including a pair of generally rectangular sub-sections 34 each having, on three sides, concave surfaces 35 between which are defined lobes 36 and, on a fourth side, a bridging portion 38 connecting the adjacent rectangular sub-sections 34 and defining a pair of sharp, narrow indentations or recesses 40 between the adjacent facing short sides thereof.

It will be appreciated that, with this cross-sectional configuration, the surface area of the filament cross-section is substantially increased in comparison with the surface area of a pair of simple rectangular sub-sections. It has also been found that the filament cross-section remains substantially uniform over the length of the filament. Hence, with increased surface area, and a substantial continuity of cross-section throughout the length of the filament, the air jet pressure in an air jet loom may be reduced to a lower value than is currently used in conjunction with current filaments having smaller surface areas and variances in cross-section throughout their lengths. Alternately, the air jet loom may be operated with yarn filaments of the present invention at higher speeds for the same cost in comparison with the loom speed when using current yarn filaments.

The invention will be further described in the following example:

EXAMPLE

Cellulose acetate dope was extruded over a period of five days through cells of spinnerets, one cell having paired jets each formed with forty octagonal-shaped orifices of this invention while the other set, as a control, included paired jets formed with forty round orifices of the prior art. The octagonal shaped orifices and round orifices were each 42μ in size. The jets having octagonal orifices and the jets having round orifices were used to simultaneously extrude cellulose acetate filaments. Processing parameters, such as the extrusion speed and dope temperature, were varied at twelve hour intervals to determine the effect upon filament cross section. Sample filaments from each jet were then analyzed at each twelve hour interval utilizing a Lietz TAS-Plus image analysis apparatus. Briefly, such apparatus automatically and objectively determines the number of lobes per filament for a filament population utilizing image scanning techniques. Statistical data for the filament population is also determined. Table 1 below shows the results with cell Nos. 1 and 8, 2 and 9, 3 and 10, etc, being comparable with respect to the processing conditions used. Also, each data point represents an average of the data for each paired jet.

TABLE 1

| Cell No. | Dope Temp (°C.) | Take-Up Speed (m/min) | Orifice Type | Average Lobes/Fil | Lobe Std. Dev. |
|---|---|---|---|---|---|
| 1 | 86 | 600 | Octagonal | 7.190 | 0.85327 |
| 2 | 90 | 700 | " | 7.040 | 0.83298 |
| 3 | 90 | 500 | " | 7.425 | 0.70769 |
| 4 | 86 | 600 | " | 7.000 | 0.87632 |
| 5 | 82 | 700 | " | 7.230 | 0.73818 |
| 6 | 82 | 700 | " | 7.170 | 0 84760 |
| 7 | 86 | 600 | " | 7.125 | 0.92981 |
| 8 | 86 | 600 | Round | 6.030 | 1.25002 |
| 9 | 90 | 700 | " | 5.580 | 1.39340 |
| 10 | 90 | 500 | " | 6.070 | 0.97699 |
| 11 | 86 | 600 | " | 6.070 | 1.25163 |
| 12 | 82 | 700 | " | 5.935 | 1.20418 |
| 13 | 82 | 700 | " | 6.090 | 1.28216 |
| 14 | 86 | 600 | " | 6.290 | 1.36928 |

As is seen in Table 1, use of octagonal spinnerets (all other conditions being similar) produces a greater average lobe count per filament. Moreover, the octagonal spinnerets of this invention produce a filament population whose standard deviation is significantly less as compared to the lobe standard deviation for filament populations produced using round orifices. This data demonstrate that filaments of this invention have less filament to filament variability with respect to lobe count for a given filament population while, at the same time, advantageously providing for an increased average number of lobes.

The filaments of this example were examined over the trial period to determine the effect, if any, that material deposit on the orifices will have on the denier of the resulting filaments. The average dpf and dpf variability were determined for each trial cell and such data is shown below in Table 2 with the dpf variability data being graphically represented by FIG. 6.

TABLE 2

| Cell No. | Orifice Type | Extrusion Time (Hours) | Average dpf | dpf Variability |
|---|---|---|---|---|
| 1 | Octagonal | 12 | 3.625 | 0.115502 |
| 2 | " | 24 | 3.620 | 0.123516 |
| 3 | " | 36 | 3.610 | 0.102058 |
| 4 | " | 48 | 3.560 | 0.103943 |
| 5 | " | 60 | 3.485 | 0.147953 |
| 6 | " | 72 | 3.240 | 0.155458 |
| 7 | " | 84 | 3.525 | 0.138430 |
| 8 | Round | 12 | 3.645 | 0.148570 |
| 9 | " | 24 | 3.685 | 0.201443 |
| 10 | " | 36 | 3.655 | 0.240451 |
| 11 | " | 48 | 3.655 | 0.246466 |
| 12 | " | 60 | 3.565 | 0.283492 |
| 13 | " | 72 | 3.635 | 0.324002 |
| 14 | " | 84 | 3.615 | 0.362518 |

As is shown in Table 2 and FIG. 6, the denier per filament variability for filaments formed using jets having multiple octagonal orifices of this invention remained low and substantially constant over time. As a comparison, jets having multiple round orifices of the prior art showed higher dpf variability factors which increased over time. This data is significant in that filaments having a greater number of lobes on average can be produced by the present invention with less lobe count variability from filament to filament and the denier variability from filament to filament can also be maintained at a low value which remains substantially constant over time.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

WHAT IS CLAIMED IS:

1. A cellulose acetate filament for the production of yarn, said filament having a cross-sectional shape comprised of a pair of generally symmetrical polygonal sub-sections each having at least three lobes and joined one to the other by a bridging portion extending between adjacent facing sides of said sub-sections.

2. A filament according to claim 1 wherein each of said sub-sections is generally rectangular in shape and has at least four lobes.

3. A filament according to claim 1 wherein each of said sub-sections has a length greater than its width with said bridging portion extending between the adjacent shorter facing sides of said sub-sections.

4. A filament according to claim 3 wherein each of said sub-sections has at least four lobes.

5. A plurality of filaments according to claim 1 forming yarn.

6. A cellulose acetate filament for the production of yarn, said filament having a cross-sectional shape comprised of a pair of polygonal sub-sections each having at least three lobes and the same number of lobes as the other sub-section, said sub-sections being joined one to the other by a bridging portion extending therebetween.

7. A filament according to claim 6 wherein said sub-sections are generally symmetrical relative to one another.

8. A filament according to claim 6 wherein said bridging portion extends between adjacent facing sides of said sub-sections.

9. A filament according to claim 8 wherein said sub-sections are generally rectangular in cross-section.

10. A plurality of filaments according to claim 6 forming yarn.

11. A yarn comprised of a plurality of cellulose acetate filaments, said filaments having a cross-sectional shape comprised of a pair of generally symmetrical polygonal sub-sections each having at least three lobes and joined one to the other by a bridging portion extending between adjacent facing sides of said sub-sections.

12. A yarn according to claim 11 wherein each of said sub-sections is generally rectangular in shape and has at least four lobes.

13. A yarn according to claim 14 wherein those filaments having at least six lobes have a cross-sectional shape comprised of a pair of polygonal sub-sections each having at least three lobes and the same number of lobes as the other sub-section, said sub-sections being joined one to the other by a bridging portion extending therebetween.

14. A cellulose acetate filament having in cross-section the general outline substantially as shown in FIG. 4.

* * * * *